US012098729B2

(12) United States Patent
Botkin et al.

(10) Patent No.: US 12,098,729 B2
(45) Date of Patent: Sep. 24, 2024

(54) CEILING FAN BLADE

(71) Applicant: HUNTER FAN COMPANY, Memphis, TN (US)

(72) Inventors: Charles William Botkin, Cordova, TN (US); Bobby Neal Norwood, Oakland, TN (US)

(73) Assignee: Hunter Fan Company, Memphis, TN (US)

( * ) Notice: Subject to any disclaimer, the term of this patent is extended or adjusted under 35 U.S.C. 154(b) by 102 days.

(21) Appl. No.: 17/592,558

(22) Filed: Feb. 4, 2022

(65) Prior Publication Data

US 2023/0250832 A1 Aug. 10, 2023

(51) Int. Cl.

*F04D 29/38* (2006.01)
*F04D 19/00* (2006.01)
*F04D 29/32* (2006.01)

(52) U.S. Cl.

CPC ..... *F04D 29/384* (2013.01); *F04D 19/002* (2013.01); *F04D 29/325* (2013.01)

(58) Field of Classification Search

CPC ..... F01D 5/141; F04D 19/002; F04D 25/088; F04D 29/325; F04D 29/384; F05D 2240/301; F05D 2240/303; F05D 2240/304

USPC ..... 416/223 R; 417/53

See application file for complete search history.

(56) References Cited

U.S. PATENT DOCUMENTS

| | | | | |
|---|---|---|---|---|
| 201,650 | A * | 3/1878 | Capern | F04D 29/384 440/98 |
| 1,981,392 | A | 11/1934 | Selman | |
| 4,550,497 | A | 11/1985 | Sharon | |
| 7,252,478 | B2 | 8/2007 | Aynsley | |
| 7,396,212 | B1 * | 7/2008 | Parker | F04D 25/088 416/223 R |
| D880,683 | S | 4/2020 | Norwood et al. | |
| 10,995,769 | B2 * | 5/2021 | Norwood | F04D 25/088 |
| 11,261,877 | B2 * | 3/2022 | Norwood | F04D 29/384 |
| 11,415,146 | B2 * | 8/2022 | Norwood | F01D 5/141 |
| 11,635,081 | B2 * | 4/2023 | Norwood | F04D 29/384 416/223 R |
| 2007/0122286 | A1 * | 5/2007 | Leung | F04D 25/088 416/210 R |
| 2007/0154315 | A1 | 7/2007 | Bucher | |
| 2009/0263254 | A1 * | 10/2009 | Bucher | F04D 29/384 29/889.71 |
| 2010/0054947 | A1 * | 3/2010 | Chen | F04D 29/38 416/223 R |
| 2015/0037164 | A1 | 2/2015 | Fizer et al. | |
| 2020/0224536 | A1 * | 7/2020 | Norwood | F04D 25/088 |
| 2020/0224670 | A1 * | 7/2020 | Norwood | F04D 29/384 |
| 2020/0224671 | A1 * | 7/2020 | Norwood | F04D 29/384 |

* cited by examiner

*Primary Examiner* — Woody A Lee, Jr.
*Assistant Examiner* — Justin A Pruitt
(74) *Attorney, Agent, or Firm* — McGarry Bair PC

(57) ABSTRACT

A ceiling fan or similar air-moving device can include a motor for rotating one or more blades to drive a volume of air about a space. The blade can include a body having an outer surface with a flat top surface and a flat bottom surface, and a side edge. A curved transition can extend between one of the flat top surface or the flat bottom surface, and the side edge. The side edge can be arranged at an angle.

13 Claims, 6 Drawing Sheets

CEILING FAN BLADE

BACKGROUND

Ceiling fans are machines typically suspended from a structure for moving a volume of air about an area. The ceiling fan includes a motor, with a rotor and stator, suspended from and electrically coupled to the structure. A set of blades mount to the rotor such that the blades are rotatably driven by the rotor, and can be provided at an angled orientation to move volume of air about the area. As the cost of energy becomes increasingly important, there is a need to improve the efficiency at which the ceiling fans operate.

BRIEF DESCRIPTION

In one aspect, the disclosure relates to a blade for a ceiling fan having a motor for rotating the blade, the blade comprising: a body including a top surface and a bottom surface, the body extending between a root and a tip in a span-wise direction and extending between a leading edge and a trailing edge in a chord-wise direction; a planar portion provided on at least one of the top surface and the bottom surface; and a planar first edge provided at one of the leading edge or the trailing edge; wherein the planar first edge is arranged at a non-zero angle relative to an axis defined orthogonal to the planar portion.

In another aspect, the disclosure relates to a ceiling fan comprising: a motor configured to suspend from a structure; a blade, rotatably driven by the motor, having a body including a top surface and a bottom surface, the body extending between a root and a tip in a span-wise direction and extending between a leading edge and a trailing edge in a chord-wise direction; a planar portion provided on the top surface; and a planar first edge provided at one of the leading edge or the trailing edge; wherein the planar first edge is arranged at a non-zero angle relative to an axis defined orthogonal to the planar portion.

In another aspect, the disclosure relates to a method for moving air within a space, the method comprising: driving a ceiling fan blade with a motor suspended from a structure at least partially defining the space; wherein the ceiling fan blade includes a planar portion provided on the top surface and a planar first edge provided at a first side edge, and wherein the planar first edge is arranged at a non-zero angle relative to an axis defined orthogonal to the planar portion.

DETAILED DESCRIPTION

Figure 1:
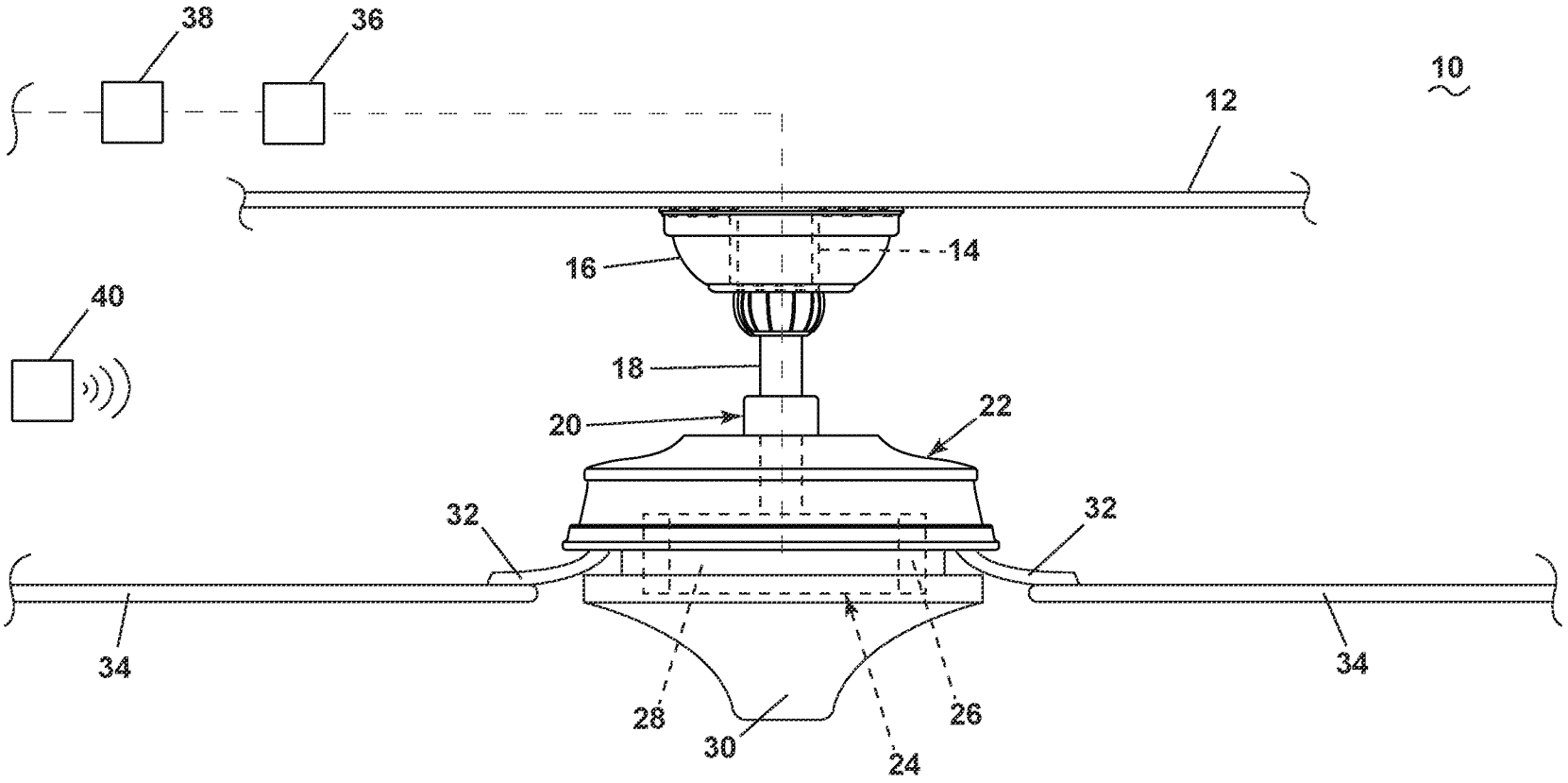
FIG. 1 is a schematic view of a structure with a ceiling fan suspended from a structure and including a set of blades.

The disclosure is related to a ceiling fan and ceiling fan blade, which can be used, for example, in residential and commercial applications. Such applications can be indoors, outdoors, or both. While this description is primarily directed toward a residential ceiling fan, it is also applicable to any environment utilizing fans or for cooling areas utilizing air movement.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a ceiling fan 10 is suspended from a structure 12. In non-limiting examples, the ceiling fan 10 can include one or more ceiling fan components including a hanger bracket 14, canopy 16, a downrod 18, a motor adapter 20, a motor housing 22 at least partially encasing a motor 24 having a rotor 26 and a stator 28, a light kit 30, and a set of blade irons 32. In additional non-limiting examples, the ceiling fan 10 can include one or more of a controller, a wireless receiver, a ball mount, a hanger ball, a light glass, a light cage, a spindle, a finial, a switch housing, blade forks, blade tips or blade caps, or other ceiling fan components. A set of blades 34 can extend radially from the ceiling fan 10, and can be rotatable to drive a volume of fluid such as air. The blades 34 can be operably coupled to the motor 24 at the rotor 26, such as via the blade irons 32. The blades 34 can include a set of blades 34, having any number of blades, including only one blade.

The structure 12 can be a ceiling, for example, from which the ceiling fan 10 is suspended. It should be understood that the structure 12 is schematically shown and is by way of example only, and can include any suitable building, structure, home, business, or other environment wherein moving air with a ceiling fan is suitable or desirable. The structure 12 can also include an electrical supply 36 can be provided in the structure 12, and can electrically couple to the ceiling fan 10 to provide electrical power to the ceiling fan 10 and the motor 24 therein. It is also contemplated that the electrical supply be sourced from somewhere other than the structure 12, such as a battery or generator in non-limiting examples.

A controller 38 can be electrically coupled to the electrical supply 36 to control operation of the ceiling fan 10 via the electrical supply 36. Alternatively, the controller 38 can be wirelessly or communicatively coupled to the ceiling fan 10, configured to control operation of the ceiling fan 10 remotely, without a dedicated connection. Non-limiting examples of controls for the ceiling fan 10 can include fan speed, fan direction, or light operation. Furthermore, a separate wireless controller 40, alone or in addition to the wired controller 38, can be communicatively coupled to a controller or a wireless receiver in the ceiling fan 10 to control operation of the ceiling fan 10. It is further contemplated in one alternative example that the ceiling fan be operated by the wireless controller 40 alone, and is not operably coupled with the wired controller 38.

Figure 2:
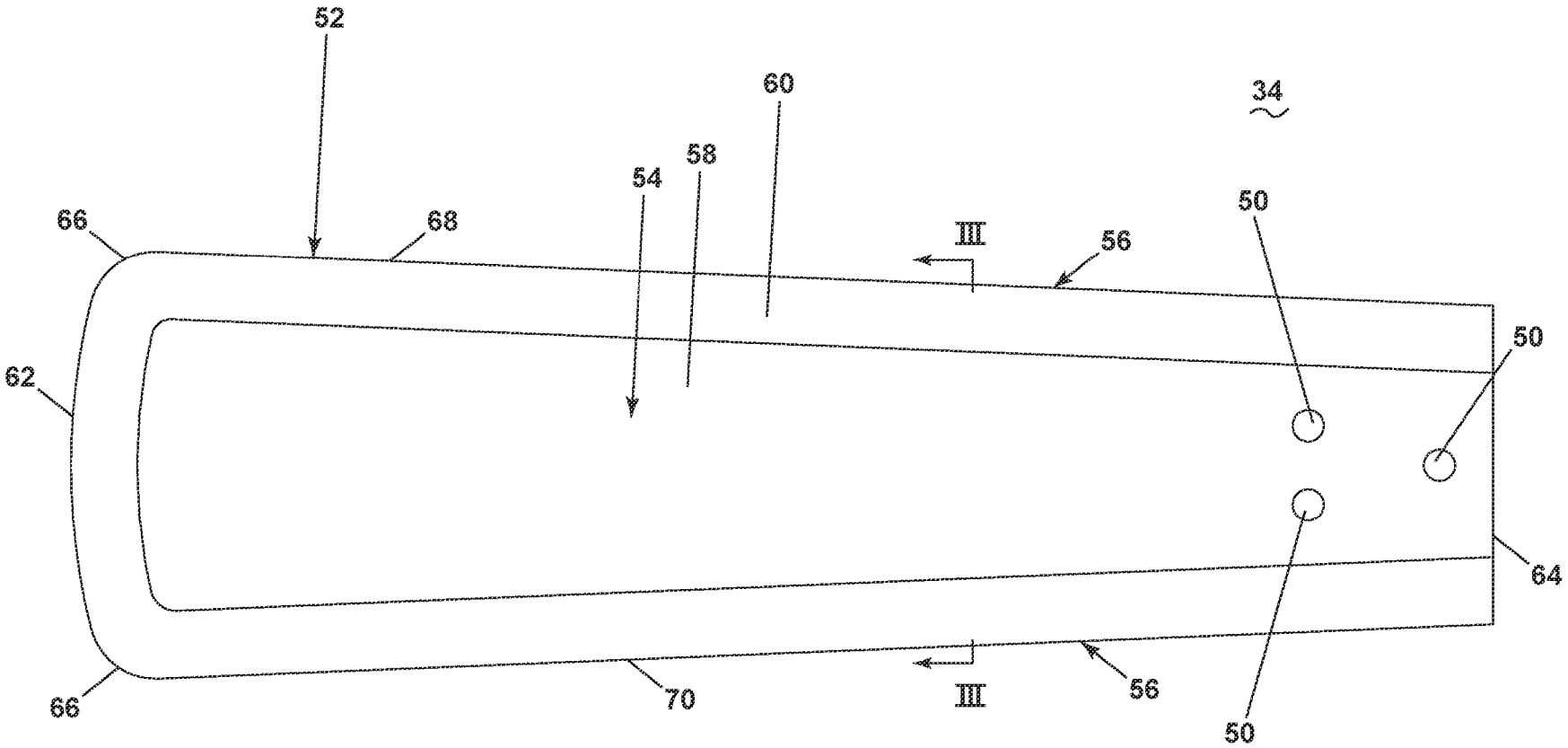
FIG. 2 is a top view of one blade from the set of blades or FIG. 1 having a curved surface transitioning to an edge of the blades.

Referring to FIG. 2, one blade 34 is isolated from the remainder of the fan 10 of FIG. 1. Three fastener apertures 50 are provided in the blade 34 for fastening the blade 34 to the motor 24 or blade iron 32 for rotating the blade 34 about the fan 10, while any number of fastener apertures or blade-attachment method is contemplated. The blade 34 includes an outer surface 52 including a top surface 54. The top surface 54 terminates at a side edge 56. The top surface 54 can include a flat portion 58 and a top curved transition 60 transitioning from the flat portion 58 to the side edge 56. Alternatively, the top surface need not be flat, but can be alternative geometries extending to the curved transition 60. In one example, the curved transition 60 can be about one inch defined in a chord-wise direction, while any width is contemplated. In another example, the curved transition 60 can extend between 5%-40% of the chord-wise width of the blade between the opposing side edges 56, while distances less than 5% or greater than 40% are contemplated.

The blade 34 further includes a tip 62 and a root 64, defining a span-wise direction therebetween, with the root 64 adjacent the fastener aperture 50 and the tip 62 opposite the root 64. Curved corners 66 transition between the tip 62 and the side edges 56, while it should be appreciated that the curved corners 66 can be optional or can include other shapes, such as sharp corners, for example. A chord-wise direction can be defined between the opposing side edges 56 and a span-wise direction can be defined between the tip 62 and the root 64. The blade 34 can widen extending in the span-wise direction, defined in the chord-wise direction, while any top-down shape for the blade is contemplated, such as having a thinning chord-wise width defined in the span-wise direction extending outwardly. Non-limiting examples of blade shapes can include squared, rectangular, curved, angled, or rounded, or combinations thereof.

Furthermore, the blade 34 can include a first edge 68 and a second edge 70 as the side edge 56, which can be arranged as a leading edge and a trailing edge, respectively, while the particular arrangement can vary based upon a rotational direction of the blade. The chord-wise direction can be defined between the first edge 68 and the second edge 70, defining a blade chord.

Further still, the curved transition 60 can extend along the entirety of the first edge 68, the second edge 70, the tip 62, or the root 64. As shown, the curved transition extends along the first and second edges 68, 70 and the tip 62, curving at the corners 66 where the side edges 68, 70 meet the tip 62.

Figure 3:
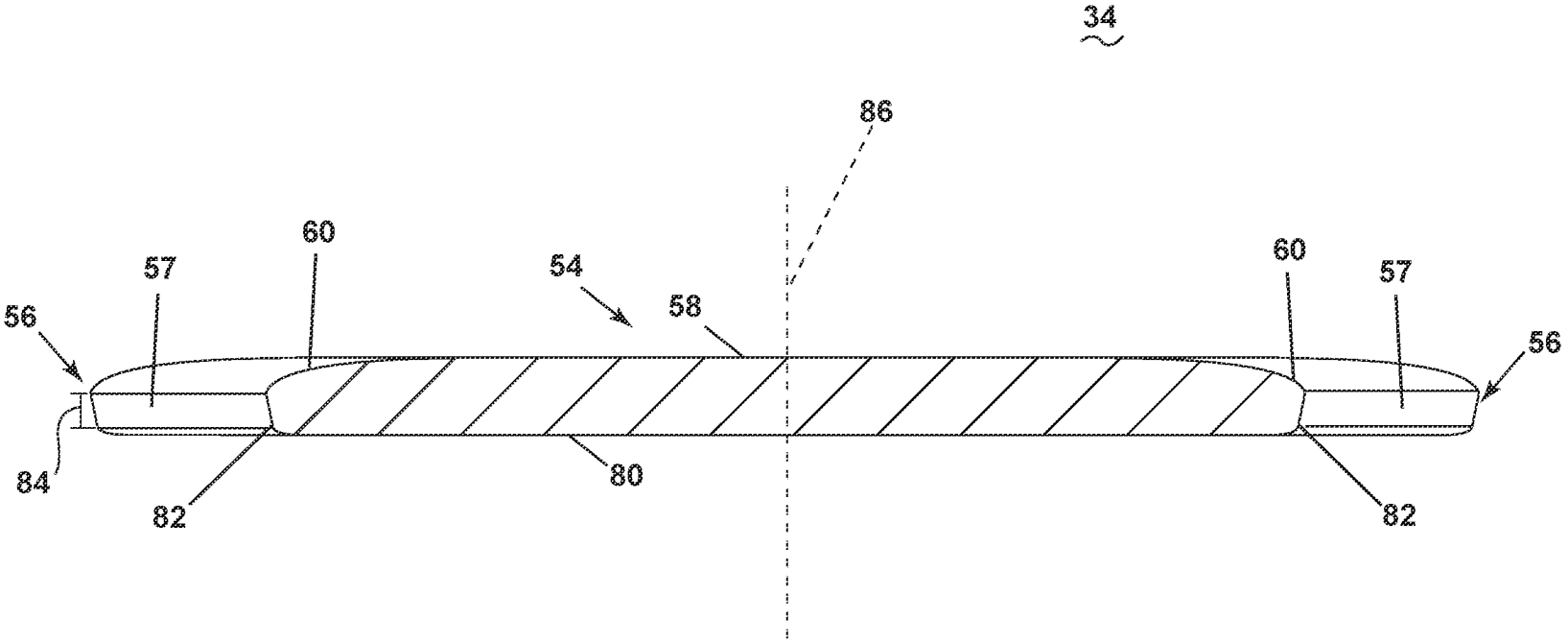
FIG. 3 is a sectional view of the blade of FIG. 2 illustrating the curved transition to the edge of the blades on a top surface and a bottom surface.

Referring to FIG. 3, taken across the section III-III of FIG. 2, the blade 34 further includes a flat bottom surface 80 and a bottom curved transition 82 transitioning from the flat bottom surface 80 to the side edge 56. The side edge 56 can have a planar surface 57. The planar surface 57 includes a width 84 to define a distance spacing the curved transition 60 at the top surface 54 from the curved transition 82 of the bottom surface 80. The blade 34 can be symmetric about a centerline 86, while it is contemplated that the blade 34 can be non-symmetric, can be curved, or can include other shapes and should not be limited to the symmetric shape as shown. The width 84 can range from 10% to 40% of the maximum thickness of the blade 34 at the centerline 86. In one non-limiting example, the width 84 can be 25% of the maximum thickness.

Furthermore, it should be appreciated that the blade 34 can be mounted at an angle of attack. The angle of attack can be defined based upon an angular position of the blade 34, such that the flat bottom surface 80 and the flat top surface 54 are arranged at an angle relative to the horizontal, or to a surface from which the ceiling fan hang or suspends above. The angle of attack permits the blade 34 to drive a volume of air, pushing the air in an upward or downward direction based upon the angle and the direction of movement of the blade 34. Without the angle of attack, the air movement generated by the blade 34 would be minimal.

Figure 4:
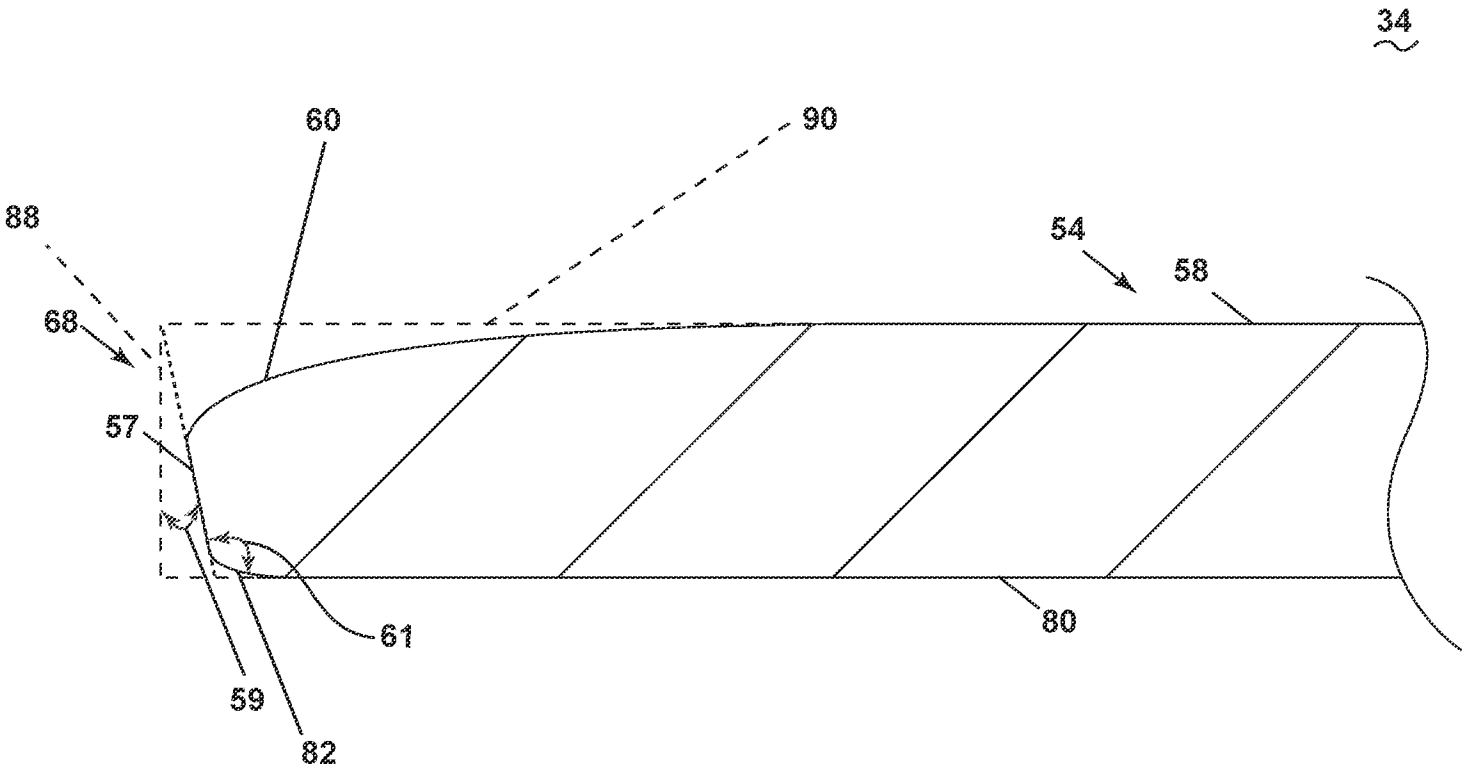
FIG. 4 is an enlarged sectional view of one edge of the blade of FIG. 3, illustrating an elliptical curved surface of the blades and a planar side edge, according to aspects disclosed herein.

Referring now to FIG. 4, an enlarged section view of the first edge 68 shows the planar surface 57 can be arranged at a first angle 59 relative to an axis 88 defined as orthogonal to the bottom surface 80 or the flat portion 58. The axis 88 can be orthogonal to both the bottom surface 80 and the flat portion 58 where the bottom surface 80 is parallel to the flat portion 58. The first angle 59 can be within the range of −89 to 89 degrees, and further contemplated that the range can include only non-zero angles. In one non-limiting example shown in FIG. 4, the first angle 59 can be a positive angle between about 0.5 degrees and 89 degrees where a positive angle defines a second angle 61 as an obtuse angle between the planar portion provided on the bottom surface 80 and the planar surface 57. Additionally, if the first angle 59 is a positive angle, the planar surface 57 can define an acute angle relative to a flat top surface 58. In a non-limiting example, the angle 59 can be between 5 and 30 degrees, or between 1 degree and 45 degrees.

Figure 5:
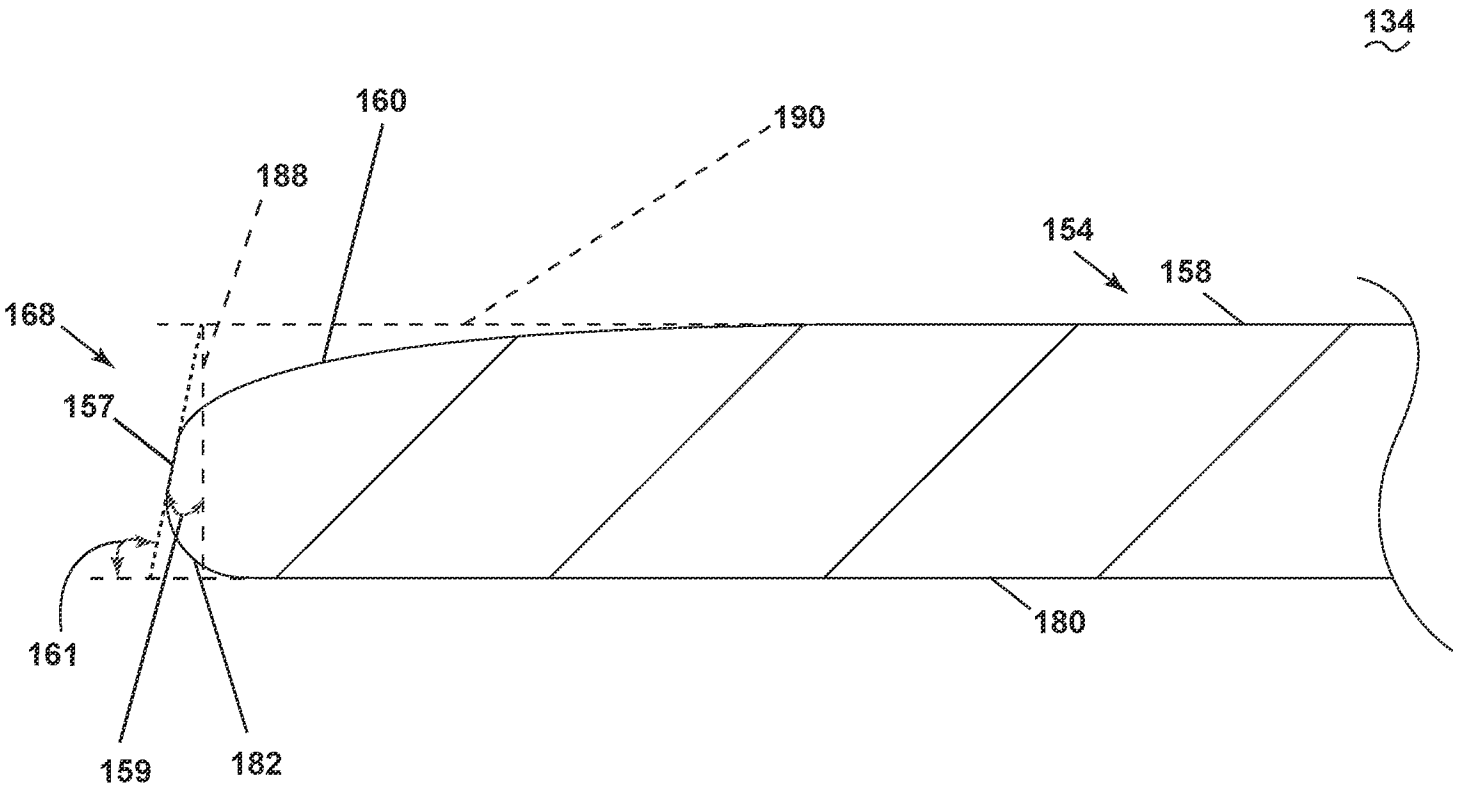
FIG. 5 is an enlarged sectional view an alternative edge of a blade, illustrating an elliptical curved surface of the blades and a planar side edge, according to aspects disclosed herein.

A non-limiting example of a blade 134 with a planar surface 157 arranged with a first angle 159 between about 0.5 degrees and −89 degrees is shown in FIG. 5. The blade 134 is similar to the blade 34; therefore, like parts will be identified with like numerals increased by 100, with it being understood that the description of the like parts of the blade 34 applies to the blade 134, unless otherwise noted. The first angle 159 can be a negative angle between about −0.5 and −89 degrees relative to axis 188. In this case, where first angle 159 is a negative angle, the second angle 161 between the planar portion provided on the bottom surface 180 and the planar surface 157 is defined as an obtuse angle. Additionally, if the first angle 159 is a negative angle, the planar surface 157 can define an obtuse angle relative to a flat top surface 158.

Further shown in FIGS. 4 and 5, the curved transitions 60, 82, 160, 182 can provide for transitioning between the top and bottom surface 54, 80, 154, 180 to the planar surface 57, 157 arranged perpendicular to the top and bottom surfaces 54, 80, 154, 180. One or both of the curved transitions 60, 82, 160, 182 can be specifically shaped as having an elliptical arc, defining at least a portion of an elliptical profile for the curved transitions 60, 82, 160, 182. More specifically, one or more of the curved transitions can be represented by equation (1) written in standard form:

$$\frac{x^2}{a^2} + \frac{y^2}{b^2} = 1 \tag{1}$$

where x represents the x-axis 88 and y represents a y-axis 90 in Cartesian coordinates. The x-axis 88 can be defined in the direction extending from the top surface 54 to the bottom surface 80, and the y-axis 90 can be defined in the chord-wise direction. Furthermore, a represents a length for the ellipse respective of the x-axis, and b represents a length for the ellipse respective of the y-axis. It should also be appreciated that where a=b, the ellipse can be a circle, defining no major or minor axis, as the diameters for a circle are equal. Additionally, all other ellipses can be non-circular, where a does not equal b, defining major and minor axes as the greatest and least diameters, respectively. Thus, it is contemplated that the curved transitions 60, 82 can define an elliptical shape, a non-circular elliptical shape, a parabolic shape, or a hyperbolic shape.

In FIG. 4, the curved transition 60 from the top surface 54 to the planar surface 57 can be represented by equation (2) below, for example:

$$\frac{x^2}{6^2} + \frac{y^2}{1^2} = 1 \tag{2}$$

where a=6 and b=1. Furthermore, the curved transition 82 from the planar surface 57 to the bottom surface 80 can be 90-degrees of a circular ellipse, represented by equation (3) below, for example:

$$\frac{x^2}{2^2} + \frac{y^2}{2^2} = 1 \tag{3}$$

where a=2 and b=2. It should be appreciated that while the curved transition 82 at the bottom surface 80 is shown as an ellipse having an equal major and minor axis forming a circle, it can alternatively be an ellipse having unequal major and minor axes. Furthermore, the specific equations representing the curved transitions 60, 82, 160, 182 can be any suitable elliptical arc, and should not be limited by the specific arcs defined by equations (2) and (3) above. The flat portion 58 and the planar surface 57 can be defined as tangent to the elliptical curvature, while an offset from tangent is contemplated.

In an example where one of the curved transitions 60, 82, 160, 182 is parabolic, an equation representing at least a portion of the curvature of the curved transition 60, 82, 160, 182 can be represented in standard form as:

$$(x-h)^2=4p(y-k) \tag{4}$$

where the focus can be defined as (h, k+p) and the directrix is defined as y=k−p·x can represent the x-axis 88 and y can represent the y-axis 90.

In another example, where one of the curved transitions 60, 82, 160, 182 is hyperbolic, an equation representing at least a portion of the curvature of the curved transition 60, 82, 160, 182 can be represented in standard form as:

$$\frac{(x-h)^2}{a^2} - \frac{(y-k)^2}{b^2} = 1 \tag{5}$$

or $$\frac{(y-k)^2}{a^2} - \frac{(x-h)^2}{b^2} = 1 \tag{6}$$

where equation (5) is based upon a horizontal transverse axis and equation (6) is based on a vertical transverse axis, which ultimately depends on the local coordinate system defining the curved transitions 60, 82, 160, 182 of the blade 34. (h, k) can be used to define a center for the hyperbola, while x can represent the x-axis 88 and y can represent the y-axis 90.

The curved transition 60, 160 at the top surface 54, 154 can have a greater chord-wise extent from the planar surface 57, 157 than that of the curved transition 82, 182 at the bottom surface 80, 180. Such a greater chord-wise extent can be defined by a greater major axis for the elliptical curvature of the curved transition 60, 160 at the top surface 54, 154, for example. Furthermore, it should be appreciated that while shown as having both curved transitions 60, 82, 160, 182, it is contemplated that the blade 34 only includes one curved transition 60, 160, with a corner or edge replacing the second curved transition 82, 182, for example, such as along the broken lines at either curved transition 60, 82, 160, 182.

Figure 6:
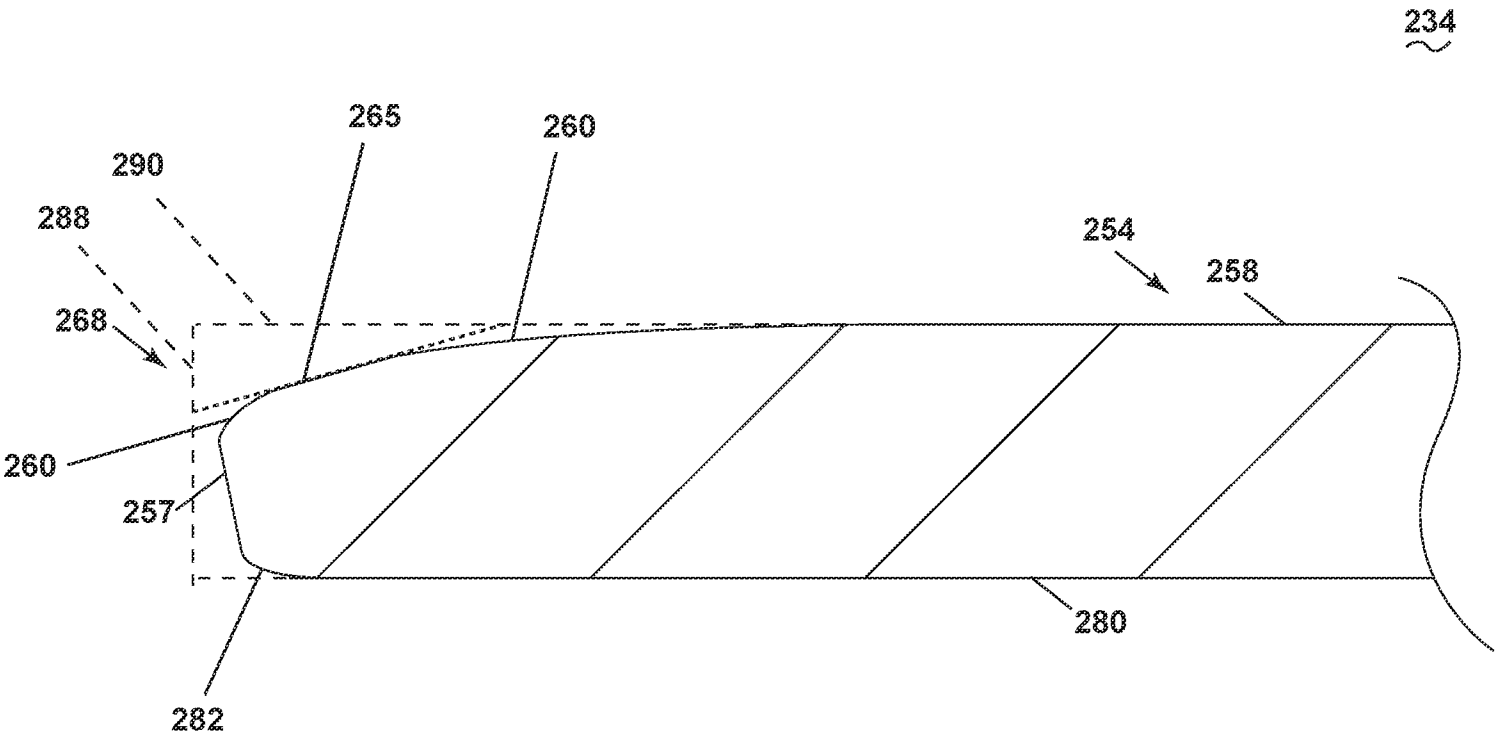
FIG. 6 is an enlarged sectional view another alternative edge of a blade, illustrating a blade with a sloped flat section, curved transition, and a planar side edge, according to aspects disclosed herein.

The blade 234 is similar to the blade 34; therefore, like parts will be identified with like numerals increased by 200, with it being understood that the description of the like parts of the blade 34 applies to the blade 234, unless otherwise noted. It should be appreciated that the curved transition 260 need not be curved, but can include any combination of curved and flat features to improve the performance of the blade. For example, as shown in FIG. 6, the curved transition 260 can include a symmetrically or unsymmetrically sloped flat section 265 that can be otherwise described as a chamfered edge. In other words, a flat sloped section can extend fully from the planar surface 257 to the flat portion 258, such that there is no curvature or any portion thereof. In another non-limiting example, a curved corner can be included between the first planar edge and one of the top surface or the bottom surface. The curved corner can extend completely between the flat portion 258 and the planar surface 257, or any portion thereof such that the curved corner does not include the planar portion. Furthermore, it is contemplated that the flat section 265 can extend fully between the flat portion 258 and the planar surface 257 It is contemplated that the curved transitions 260, 282 can define an elliptical shape, a non-circular elliptical shape, a parabolic shape, or a hyperbolic shape as described above.

It should be appreciated that one or more curved transitions between the top surface and the bottom surfaces, and the planar surface can provide for increased efficiency for the blade. As both the first edge and the second edge can include the curved transitions, such an efficiency gain can be appreciated in either rotational direction of the blade. Furthermore, the elliptical geometry for the one or more curved transitions can provide for improved efficiency for the blades, as compared to a blade without a curved transition or with a standard non-elliptical curved transition or circular transition alone.

The blades and sections thereof as described herein provide for both increased total flow volume for a ceiling fan, resulting in increased efficiency, while maintaining the aesthetic appearance having an unadorned bottom surface of a ceiling fan that consumers desire. More specifically, the curved transitions, or elliptical geometry thereof, provide for increased downward force on air which increases the total volume of airflow, while the flat upper and lower surfaces of the blade match traditional fan blade styles, providing a pleasing or appealing user aesthetic.

To the extent not already described, the different features and structures of the various features can be used in combination as desired. That one feature is not illustrated in all of the aspects of the disclosure is not meant to be construed that it cannot be, but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blade for a ceiling fan having a motor for rotating the blade, the blade comprising:

a body including a top surface and a bottom surface, the body extending between a root and a tip in a span-wise direction and extending between a leading edge and a trailing edge in a chord-wise direction, with at least one of the leading edge and trailing edge including a side edge defining a planar first surface;

a planar portion provided on at least one of the top surface or the bottom surface;

a transition portion provided on the least one of the top surface or the bottom surface and extending between the planar portion and the side edge; and wherein the planar first surface is arranged at a non-zero angle relative to an axis defined orthogonal to the planar portion and the non-zero angle is between 5 degrees and 30 degrees.

2. The blade of claim 1 wherein the transition portion comprises a performance feature.

3. The blade of claim 2 wherein the performance feature is one of an elliptical curvature, a chamfered surface, or a curved surface.

4. The blade of claim 3 wherein the performance feature includes the elliptical curvature, where the planar portion and the planar first surface are defined as tangent to the elliptical curvature.

5. The blade of claim 3 wherein the performance feature is the chamfered surface, and the chamfered surface spaces the planar portion and the planar first surface extending between the root and the tip.

6. The blade of claim 1 wherein the planar portion and the first planar surface extend between the root and the tip.

7. The blade of claim 1 further comprising a curved corner defined between the first planar surface and one of the top surface or the bottom surface which does not include the planar portion.

8. A ceiling fan comprising:

a motor configured to suspend from a structure;

a blade, rotatably driven by the motor, having a body including a top surface and a bottom surface, the body extending between a root and a tip in a span-wise direction and extending between a leading edge and a trailing edge in a chord-wise direction, with at least one of the leading edge and trailing edge including a side edge defining a planar first surface;

a planar portion provided on the top surface;

a transition portion provided on the top surface and extending between the planar portion and at least one of the trailing edge or leading edge; and wherein the planar first surface is arranged at a non-zero angle relative to an axis defined orthogonal to the planar portion and the non-zero angled is between 5 degrees and 30 degrees.

9. The ceiling fan of claim 8 wherein the transition portion comprises a performance feature.

10. The ceiling fan of claim 9 wherein the performance feature is one of an elliptical curvature, a chamfered surface, or a curved surface.

11. A method for moving air within a space, the method comprising:

driving a ceiling fan blade with a motor suspended from a structure at least partially defining the space;

wherein the ceiling fan blade includes a planar portion provided on a top surface, a planar first surface defining a side edge for at least one of a leading edge or trailing edge, a transition portion provided on the least one of the top surface or the bottom surface and extending between the planar portion and at least one of the trailing edge or leading edge, and wherein the planar first surface is arranged at a non-zero angle relative to an axis defined orthogonal to the planar portion and the non-zero angle is between 5 degrees and 45 degrees.

12. The method of claim 11 wherein the transition portion comprises a performance feature.

13. The method of claim 12 wherein the non-zero angle provides increased efficiency for the ceiling fan relative to an angle that is zero.

* * * * *